United States Patent [19]

Mendelson

[11] 3,995,852

[45] Dec. 7, 1976

[54] TEETER BOARD DEVICE

[76] Inventor: Barry Mendelson, 1 Topaz Court, Spring Valley, N.Y. 10977

[22] Filed: Aug. 8, 1975

[21] Appl. No.: 603,040

[52] U.S. Cl. ..... 272/111

[51] Int. Cl.[2] ..... A63B 23/04

[58] Field of Search ..... 272/56, 1 R, 1 E, 33 A, 272/57 A, 57 B, 57 D, 57 J, 57 R, 60 R, 70, 54, 55; 280/205, 87.04 R, 87.04 A, 47.3, 47.32; D34/5 B, 5 C, 5 D, 5 K, 15 AJ

[56] References Cited

UNITED STATES PATENTS

| | | | |
|---|---|---|---|
| 1,406,641 | 2/1922 | Hardy | 272/70 X |
| 2,253,996 | 8/1941 | Bechman | 272/70 |
| 2,726,845 | 12/1955 | Hyslop, Jr. et al. | 272/56 X |
| 2,764,411 | 9/1956 | Washburn, Jr. | 272/1 R |
| 2,829,891 | 4/1958 | Ludwig | 272/1 R |
| 2,829,892 | 4/1958 | Ludwig | 272/1 R |
| 3,109,645 | 11/1963 | Thorson | 272/54 |
| 3,298,687 | 1/1967 | Douglas | 272/60 R |
| 3,630,540 | 12/1971 | Smith | 272/60 R X |
| 3,833,215 | 9/1974 | Isdith | 272/60 R |
| D220,115 | 3/1971 | Semler | 272/54 UX |

FOREIGN PATENTS OR APPLICATIONS

| | | | |
|---|---|---|---|
| 1,419,480 | 10/1965 | France | 272/60 R |

*Primary Examiner*—Richard C. Pinkham
*Assistant Examiner*—Arnold W. Kramer
*Attorney, Agent, or Firm*—Jerome P. Bloom

[57] ABSTRACT

A toy device comprising an exercising teeter board mounted for rotation on and for movement with a rolling base. The board and its base are especially configured so that portions of one nests within the other so as to preclude a lateral or longitudinal shifting motion of one relative the other. This design lends significant safety features in that it permits persons riding the respective ends of the board, whether standing or sitting, to tilt the board and induce its longitudinal back and forth movement with its rolling base without fear of being thrown from the board due to a twisting or a longitudinal or lateral shifting movement of the board with reference to its base.

9 Claims, 4 Drawing Figures

TEETER BOARD DEVICE

BACKGROUND OF THE INVENTION

Teeter boards as heretofore known have been generally mounted on a stationary base so as to provide them with a tilting motion about an intermediately positioned support. As thus provided they have been relatively static devices the use of which has required no exercise of skill or agility on the part of its riders. The use thereof has for this reason been limited and has lacked appeal to other than the youngest of children.

One effort has been made to enhance the appeal of the teeter board. This is exhibited in U.S. Design Patent 220,115. Here, however, the inventor has merely provided an undercarriage for a teeter board in the form of a rigid frame secured to a wheeled shaft.

There have, in the past, been some balancing boards which have had a roller type base to give them dynamic features. However, these have offered a precarious position for a rider, being intended for use by a single rider in an upright position and the board thereof being invariably shiftable with respect to its rolling base. Moreover, the balancing boards of the prior art have never particularly lent themselves to a safe use as a teeter board.

SUMMARY OF THE INVENTION

The deficiencies of the prior art devices in the nature of teeter board or balancing devices, as above noted, have been obviated by the present invention which provides an exercising toy device having the characteristics of both without their drawbacks. Embodiments of the present invention provide a teeter board device wherein a teeter board bears for tilting movement on and is physically coupled with a relatively rotatable spool-like base. In preferred embodiment the base is provided with a generally V-shaped circumferential groove nesting the undersurface of the related teeter board which has a complementary configuration, in transverse section. Included in connection with the undersurface of the teeter board, at its center, is a clip means adapted to embrace and contain in bearing rotatable relation thereto the portion of the spool-like base which is centered intermediate its ends.

In accordance with the invention, both the teeter board and the spool-like member forming its base may be made of plastic in a molding or like operation productive of light weight, strong and durable elements. The nature of the assembly provided is such that it is portable, whether assembled or disassembled, and it may be used indoors or out.

In use of the invention embodiments riders may sit or stand on opposite ends of the teeter board and induce therein conventional tilting motions capable of providing a high degree of stimulation by reason of the relatively free rolling motion which may be induced in the relatively rotatable base.

The connection of elements of the teeter board device as provided by the invention is such that it is virtually impossible that the teeter board be thrown from or dislodged from its required position in connection with its relatively rotatable base. Moreover, the teeter board is embodied with means through the medium of which a rider of the board may induce a braking motion of the board to prevent accidents being induced in its use by over exuberant individuals.

An object of the invention is to provide a new teeter board device in the nature of an exercising toy which is economical to manufacture, more efficient and satisfactory in use, adaptable to a wide variety of applications and unlikely to malfunction.

A further object of the invention is to provide an improved teeter board device capable of providing its riders with means to effect independent or simultaneous tilting and rolling movements.

An additional object of the invention is to provide a teeter board device for a plurality of riders the use of which involves a test of their skill and agility.

Another object of the invention is to provide a teeter board device which has a simple, light weight and inexpensive construction, is readily portable and usable indoors or out.

A further object of the invention is to provide a rolling base and an overlying board which simply and uniquely interconnect to define an integrated teeter board assembly allowing relative rolling motion of the base and relative tilting motion of the board while inhibiting their relative lateral and longitudinal displacement.

Another object of the invention is to provide a teeter board assembly in which the board is effectively recessed into the base in a manner to lower its center of gravity and to provide that forces applied laterally of the board may be absorbed by the base.

An additional object of the invention is to provide a teeter board device possessing the advantageous structural features, the inherent meritoreous characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein is shown one but not necessarily the only form of embodiment of the invention, FIG. 1 is view in perspective of a teeter board device according to the illustrated embodiment of the invention;

Like parts are indicated by similar characters of reference throughout the several views.

In its illustrated form the teeter board device of the invention comprises a base 10 and a board 11 releasably connected to form a unitary, mobile and portable assembly.

The base 10 has a spool-like configuration. It is comprised of frusto-conical end sections 12 and 13 which are axially aligned and have their truncated apex portions held in an adjacent end spaced relation by an interconnecting cylindrical portion 14. This provides the outer periphery of the spool with a generally V-shaped circumferential groove.

Figure 1:
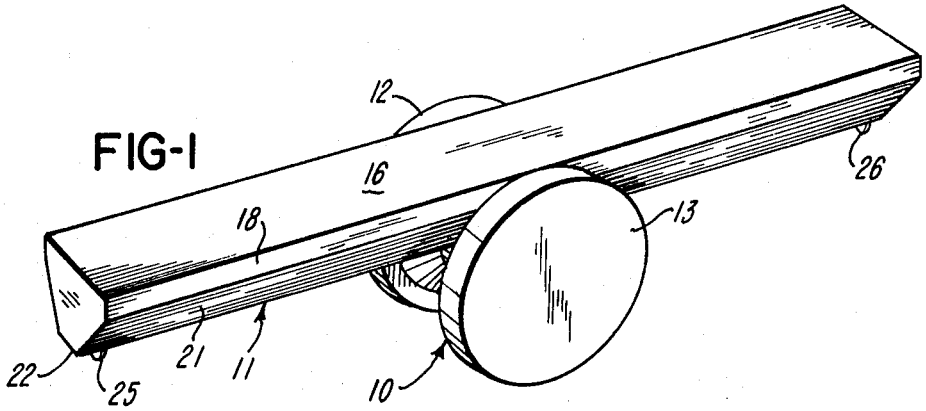
Figure 2:
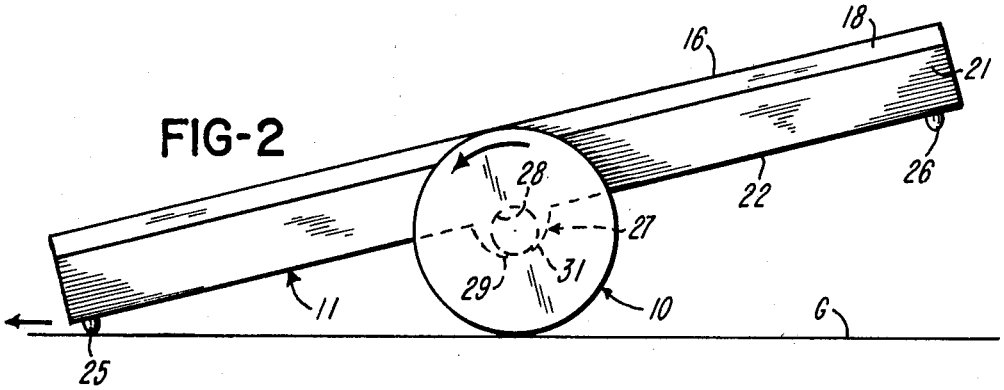
FIG. 2 is a side elevation view of the device of FIG. 1.
Figure 3:
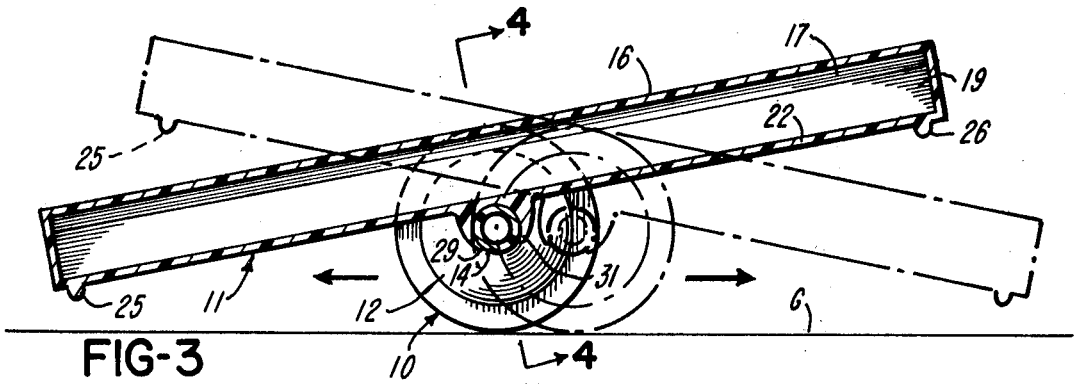
FIG. 3 is a view like FIG. 2, the parts being shown in longitudinal section and in a manner to demonstrate the tilting and rolling movements which can be achieved in use thereof.
Figure 4:
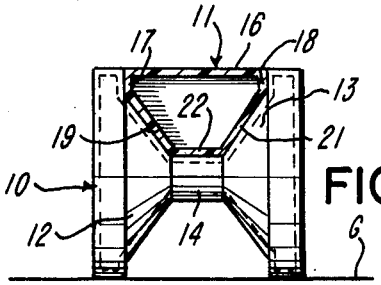
FIG. 4 is a cross sectional view taken substantially along the lines 4—4 of FIG. 3.

In use the base 10 is placed on its side. In this position of the base, the peripheral surface portions of the remote ends of the frusto-conical sections 12 and 13, which are cylindrical in shape, mount in a rolling bearing contact with an underlying ground surface G (FIGS. 2–4). This provides that the longitudinal axis of the spool-shaped base, as well as the outer peripheral surface of its cylindrical portion 14, will dispose in a generally spaced elevated relation to the ground surface G.

While it will be obvious that the base 10 may be made of suitably configured multiple parts bolted together or otherwise interconnected, according to a feature of the invention the base is a hollow structure and made in one-piece of plastic or other light weight durable material, in a suitable forming operation.

As illustrated, the board 11 is also a hollow structure, preferably molded of plastic to form an elongated beam. In the forming process the beam is given a top side providing it with a flat planar shaped surface 16 capable of accommodating riders in either a sitting or standing position. The side wall portions of the beam 11 are formed to include upper portions 17 and 18 which have a limited vertical extent and are formed to depend from and in a sense perpendicular to the top surface 16, at its lateral edges. The dependent extremities of the upper side wall portions 17 and 18 merge with and are continued by inwardly sloped side wall portions 19 and 21. The latter, which are directed to converge in a downward sense, are sloped to have dependent extremities closely spaced and bridged by a bottom wall portion 22 of the beam 11. The bottom surface of the bottom wall portion 22 is arranged to be parallel to the top surface 16.

Attention is directed to the fact that the outline of the lowermost portion of the beam 11 as defined by its convergent side wall portions 19 and 21 and the bottom wall 22 has a configuration and dimension to be complementary in shape to that of the wall structure of the base 10 which defines, circumferentially and peripherally thereof, the aforementioned generally V-shaped groove.

To each of the respective ends thereof, the bottom wall 22 of the beam 11 is formed with an integrated, relatively projected, braking skid, the skid to one end thereof being designated by the numeral 25 and the skid to the other end thereof being designated by the numeral 26. Also provided in connection with the bottom of the beam at its mid point, is a dependent portion 27 the underside of which is recessed to define a concave, generally semicylindrical downwardly facing bearing surface 28. The latter is formed about a center transverse to the longitudinal axis of the beam 11. The portion 27 terminates in fore and aft deflectable fingers 29 and 31 which extend the bearing surface 28 to form a bearing pocket the wall surface of which is continuous over a circumferential distance exceeding 180°.The bearing surface 28 is formed on a radius which corresponds, substantially, to that of the cylindrical portion 14 of the base 10.

Thus, the undersurface of the beam 11 has a generally V-shaped outline complementary to and adapted to firmly nest in the V-shaped groove provided circumferentially of the base 10. In this respect, it will be seen that the bottom wall portion 22 of the beam 11 has a width corresponding approximately to the length of the cylindrical portion 14 of the base 10.

In the assembling of the parts 10 and 11, the beam 11 is naturally placed in a position transverse to the longitudinal axis of the base 10 which is centered thereunder. Then, in an approaching movement of the parts, the fingers 29 and 31 of the dependent beam portion 27 are deflected as the base portion 14 is snap fit in the dependent portion 27 of the beam 11. This provides that the cylindrical portion 14 of the base is brought into bearing contact with the bearing surface 28, whereupon the fingers 29 and 31 will dispose in an embracing relation to the base portion 14. It will be obvious, since the fingers 29 and 31 are yieldable, that the base 10 may be readily disengaged from the beam 11 even though the connection provided between the beam 11 and base 10 is quite secure until one is pried apart from the other.

On assembly of the base 10 and the beam 11 in a manner as above described or in a similar manner, the beam 11 is so mounted to permit the free relative rotation of its base 10 and to be freely tiltable thereon during such relative rotation though coupled firmly thereto. By virtue of the configuration of the beam 11 and the base 10, it will be seen that as one is nested with respect to the other there is a substantial bearing relation therebetween and the conical surface portions of the base sections 12 and 13 provide for substantial lateral confinement of the wall portions 19 and 21 of the beam 11. The result of this is to interrelate the beam to the base in a manner to substantially preclude twisting or lateral displacement of the beam relative to its base or longitudinal shifting of the beam with respect to its base. Further, as nested in its base, the center of gravity of the board lies within the boundaries of the rolling base. This insures substantial stability for the teeter board device provided as described. Further, the configuration of the respective elements of the teeter board device is such that riders of the beam 11, whether sitting or standing, will find that the forces which they apply to the beam 11 will be readily accommodated and absorbed within the boundaries of the most stable base. The total of the features with which the teeter board is endowed is such that riders sitting or standing on the beam may execute various maneuvers ranging from simple teetering with or without base movement to more demanding balancing feats executed while the base 10, stably mounting the beam 11, in coupled relation thereto, rolls over the ground surface G.

It is of course obvious, though not preferred, that the fingers 29 and 31 in connection with and extending the bearing surface 28 provided at the undersurface of the portion 27 of the beam 11 can be omitted, in which case the bearing surface can be made to encompass no more than 180° of the circumference of the cylindrical portion 14 of the base. This will create an assembly demanding greater dexterity in use. Such assembly will, however, afford a degree less safety than would be provided if the fingers 29 and 31 are employed.

With the base 10 and the beam 11 interconnected into an operating unit, it can be used by persons of various size and capability in a manner to offer various degrees of excitement and stimulation. The unit may be employed by the very young sitting on the respective ends of the beam 11, whereupon a gentle rocking of the beam may be achieved with little or no relative rolling movement of the base 10. In such case there is offered both safety in use and some bit of gentle excitement in the rolling movement occasioned by the forces applied in rocking the beam. By contrast, the teeter board device of the invention may be used by two agile persons with one standing on the upper surface of the beam 11 to either end. In such case, the persons can relatively induce vigorous movements of the beam 11 with a view to achieving various balancing feats and possibly to dislodging a person from the board. In either mode of use described, the braking skids 25 and 26 may come into play to offer a further safety feature. It will be obvious that by depressing one end of the board or the other that a braking skid could be brought into contact with the ground surface G to prevent a runaway of the roller type base. Normally this will inherently occur if the action gets too vigorous.

From the foregoing it will be seen that the invention provides a highly entertaining structure, one that offers a considerable range of use and pleasure. The appeal of such a device, particularly in view of its safety features, is obviously substantial.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A teeter board device, including a base formed for free rolling motion over a supporting surface and providing thereon a relatively elevated bearing portion, said base having a circumferential groove which is substantially V-shaped in cross section, wall surfaces of said base defining said groove being interconnected by said elevated bearing portion, a beam disposed in substantially overlying relation to said base and having freely projecting ends on which riders may position themselves, the undersurface of said beam being complementarily shaped to nest in said groove in substantially bearing engagement with said wall surfaces, cooperating therewith to thereby dissipate therebetween any forces which might otherwise tend to induce a lateral displacement of one of said base or said beam relative the other, and means mounting said beam to said bearing portion of said base, said mounting means being formed to accommodate simultaneous relative rolling motion of said base and relative tilting motion of said beam on said base while inhibiting endwise motion of said beam relative to said base.

2. A teeter board according to claim 1 characterized in that said base has a spool-like configuration, end sections of said base including opposing frusto-conical portions and truncated apex portions of said end sections being interconnected by a cylindrical portion defining said relatively elevated bearing portion.

3. A teeter board device according to claim 2, wherein said base and said beam are defined by continuing walls respectively forming a unitary hollow structure.

4. A teeter board according to claim 1 characterized in that said mounting means is intermediate the ends of said beam and provides a recessed pocket the defining wall surface of which is adapted to encompass and bear on said elevated bearing portion of said base.

5. A teeter board according to claim 4 wherein said base has a spool-like configuration, end sections of said base being formed of opposing frusto-conical portions and truncated apex portions of said end sections being interconnected by a cylindrical portion defining said relatively elevated bearing portion, the wall surface of said recessed pocket defining a concave generally semi-cylindrical downwardly facing surface for complementary bearing engagement with said cylindrical bearing portion.

6. A teeter board according to claim 5 wherein the downwardly facing surface of said recessed pocket is extended by flexible fingers which embrace said cylindrical bearing portion.

7. A teeter board according to claim 4 characterized in that said beam, in cross section, has a configuration providing it with a flat upper surface and sides at least the dependent portions of which converge and have their dependent convergent extremities bridged by a bottom surface portion of the beam which is generally parallel to its upper surface, and means on said bottom surface portion of said beam provides said recessed pocket.

8. A teeter board device according to claim 7 wherein other portions of the bottom surface portion of said beam are formed as projected braking skids.

9. A teeter board device as in claim 1 wherein said beam, in a lateral sense, is substantially fully nested in said base.

* * * * *